US008515322B2

(12) United States Patent
Inaba et al.

(10) Patent No.: US 8,515,322 B2
(45) Date of Patent: Aug. 20, 2013

(54) IMAGE FORMING APPARATUS

(75) Inventors: Yuichiro Inaba, Chigasaki (JP); Hiromi Sakurai, Suntou-gun (JP); Toshiyuki Watanabe, Mishima (JM)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 13/094,272

(22) Filed: Apr. 26, 2011

(65) Prior Publication Data

US 2011/0274472 A1 Nov. 10, 2011

(30) Foreign Application Priority Data

May 10, 2010 (JP) ..... 2010-108626

(51) Int. Cl.
*G03G 15/01* (2006.01)

(52) U.S. Cl.
USPC ..... 399/302; 399/395

(58) Field of Classification Search
USPC ..... 399/302, 303, 308, 394, 395
See application file for complete search history.

(56) References Cited

U.S. PATENT DOCUMENTS

2009/0311013 A1* 12/2009 Hara ..... 399/302
2010/0310283 A1* 12/2010 Okamoto ..... 399/302

FOREIGN PATENT DOCUMENTS

JP 11-223971 A 8/1999
JP 2003-215943 A 7/2003
JP 2007-79399 A 3/2007
JP 2007-304230 A 11/2007

* cited by examiner

*Primary Examiner* — Hoang Ngo
(74) *Attorney, Agent, or Firm* — Fitzpatrick, Cella, Harper & Scinto

(57) ABSTRACT

An image forming apparatus including: guide portions provided in strips on opposite ends of an inner circumferential surface of an endless belt; a driving roller supporting the endless belt; a driven roller supporting the endless belt; first restriction members having first contact surfaces which come into contact with the guide portions when the endless belt moves in a belt width direction; and second restriction members having second contact surfaces which come into contact with the guide portions when the endless belt moves in the belt width direction, the second contact surfaces are placed nearer to a center in the belt width direction than the first contact surfaces, and an angle between the first contact surfaces and the inner circumferential surface in the belt width direction is larger than an angle between the second contact surfaces and the inner circumferential surface in the belt width direction.

8 Claims, 8 Drawing Sheets

IMAGE FORMING APPARATUS

BACKGROUND OF THE INVENTION

1. Field of the Invention

The present invention relates to an image forming apparatus such as a color copier or color printer which uses an electrophotographic process.

2. Description of the Related Art

An electrophotographic process using a toner is often used for an image forming apparatus such as a copier, laser printer, or facsimile machine. The electrophotographic process includes a transfer step of transferring toner images, i.e. developer images, carried on a photosensitive drum which acts as an image bearing member to a surface of a transfer material conveyed by a transfer material conveying belt or intermediate transfer belt. A transfer belt such as a transfer material conveying belt or intermediate transfer belt are stretched around multiple tension rollers and configured to rotate and move when a driving roller rotates. The transfer belt could move to one side along a belt width direction orthogonal to a rotational direction during the rotating movement. For restricting a movement in the belt width direction crossing the rotational direction of the belt, in Japanese Patent Application Laid-Open No. H11-223971, ribs are installed as guide portions along opposite ends of an inner circumferential surface of the transfer belt. The ribs are abutted against flanges provided on a driving roller, and the movement in the belt width direction crossing the rotational direction of the belt is restricted by the ribs.

In Japanese Patent Application Laid-Open No. 2003-215943, a rib is installed along one end of an inner circumferential surface of a transfer belt and rib guides (grooves) are installed at one end of multiple rollers (a driving roller and driven roller) around which an intermediate transfer belt is stretched. The grooves guide the rib by putting the rib therein so that the ends of the belt will not bend inward due to belt tension. The rib guide placed on the driven roller restricts the belt-move in the belt width direction. The rib guide placed on the driving roller is movable by a predetermined amount in the belt width direction, and thus does not block the movement of the rib in the belt width direction.

Normally, to stably convey the transfer belt, a rubber layer with a high coefficient of friction $\mu$ is provided on a surface of the driving roller which drives the transfer belt. In Japanese Patent Application Laid-Open No. H11-223971, a moving force on the driving roller in the belt width direction is increased. When restriction forces of rib guides on the ribs increase, loads on the belt and ribs increase. Consequently, ribs of the transfer belt become less durable, resulting in breakage in some cases.

The belt-move is restricted as the belt bumps against the flanges which serve as restriction members. Consequently, when the moving force increases, the ribs may run on the flanges. If the ribs run on the flanges, the transfer belt floats up minutely from a surface of the driving roller, causing changes to driving diameter of the belt and thereby resulting in changes in rotational speed of the transfer belt. This destabilizes position detection of the transfer belt, making it difficult to synchronize image write positions and thereby resulting in color misregistration.

In Japanese Patent Application Laid-Open No. 2003-215943, the use of an intermediate transfer belt with a short circumferential length results in an increased travel amount D of the belt in the belt width direction on the driving roller, increasing a D/B ratio, where B is a center distance between the driving roller and driven roller. This in turn increases an amount of diagonal deformation of the belt itself, causing the belt to undulate and thereby affecting images. To solve this problem, it is conceivable to use high-rigidity material such as polyimide for the intermediate transfer belt or perform feedback control of alignment of the driving roller by using an actuator to prevent the belt from moving in the belt width direction, but these methods will result in cost increases.

SUMMARY OF THE INVENTION

The present invention provides an image forming apparatus which can restrict a belt-move in the belt width direction at low costs with extended service life and form high quality images. Hereinafter, the belt-move in the belt width direction is called "skew".

The present invention provides an image forming apparatus, which transfers a toner image to a rotatable endless belt or transfers a toner image to a transfer material carried by a rotatable endless belt, including: the rotatable endless belt; guide portions each provided in strips on opposite ends of an inner circumferential surface of the endless belt; a driving roller supporting and rotating the endless belt; a driven roller supporting the endless belt and driven by the rotation of the endless belt; first restriction members each provided on opposite ends of the driven roller in an axial direction of the driven roller, the first restriction members having first contact surfaces which come into contact with the guide portions when the endless belt moves in a belt width direction crossing a rotational direction of the endless belt; and second restriction members each provided on opposite ends of the driving roller in an axial direction of the driving roller, the second restriction members having second contact surfaces which come into contact with the guide portions when the endless belt moves in the belt width direction crossing the rotational direction of the endless belt, wherein the second contact surfaces of the second restriction members are placed nearer to a center in the belt width direction than the first contact surfaces of the first restriction members, and an angle between the first contact surfaces of the first restriction members and the inner circumferential surface in the belt width direction is larger than an angle between the second contact surfaces of the second restriction members and the inner circumferential surface in the belt width direction.

The present invention provides an image forming apparatus, which transfers a toner image to a rotatable endless belt or transfers a toner image to a transfer material carried by a rotatable endless belt, including: the rotatable endless belt; a guide portion provided in a strip at one end of an inner circumferential surface of the endless belt; a driving roller supporting and rotating the endless belt; a driven roller supporting the endless belt and driven by the rotation of the endless belt; a first restriction member provided on the driven roller on the side of the one end in an axial direction of the driven roller, the first restriction member having a first contact surface which comes into contact with the guide portion when the endless belt moves in a belt width direction crossing a rotational direction of the endless belt; and a second restriction member provided on the driving roller on the side of the one end in an axial direction of the driving roller, the second restriction member having a second contact surface which comes into contact with the guide portion when the endless belt moves in the belt width direction crossing the rotational direction of the endless belt, wherein the second contact surface of the second restriction member is placed nearer to a center in the belt width direction than the first contact surface of the first restriction member, and an angle between the first contact surface of the first restriction member and the inner circumferential surface in the belt width direction is larger than an angle between the second contact surface of the second restriction member and the inner circumferential surface in the belt width direction.

Further features of the present invention will become apparent from the following description of exemplary embodiments with reference to the attached drawings.

BRIEF DESCRIPTION OF THE DRAWINGS

FIG. 7 is a conceptual diagram showing an amount of belt run-on.

DESCRIPTION OF THE EMBODIMENTS

Preferred embodiments of the present invention will now be described in detail in accordance with the accompanying drawings. However, the sizes, materials, shapes and relative locations of the components described in the following embodiments are to be changed as required depending on the configuration and conditions of the apparatus to which the present invention is applied, and the scope of the present invention is not limited to the embodiments described below.

First Embodiment

Figure 1:
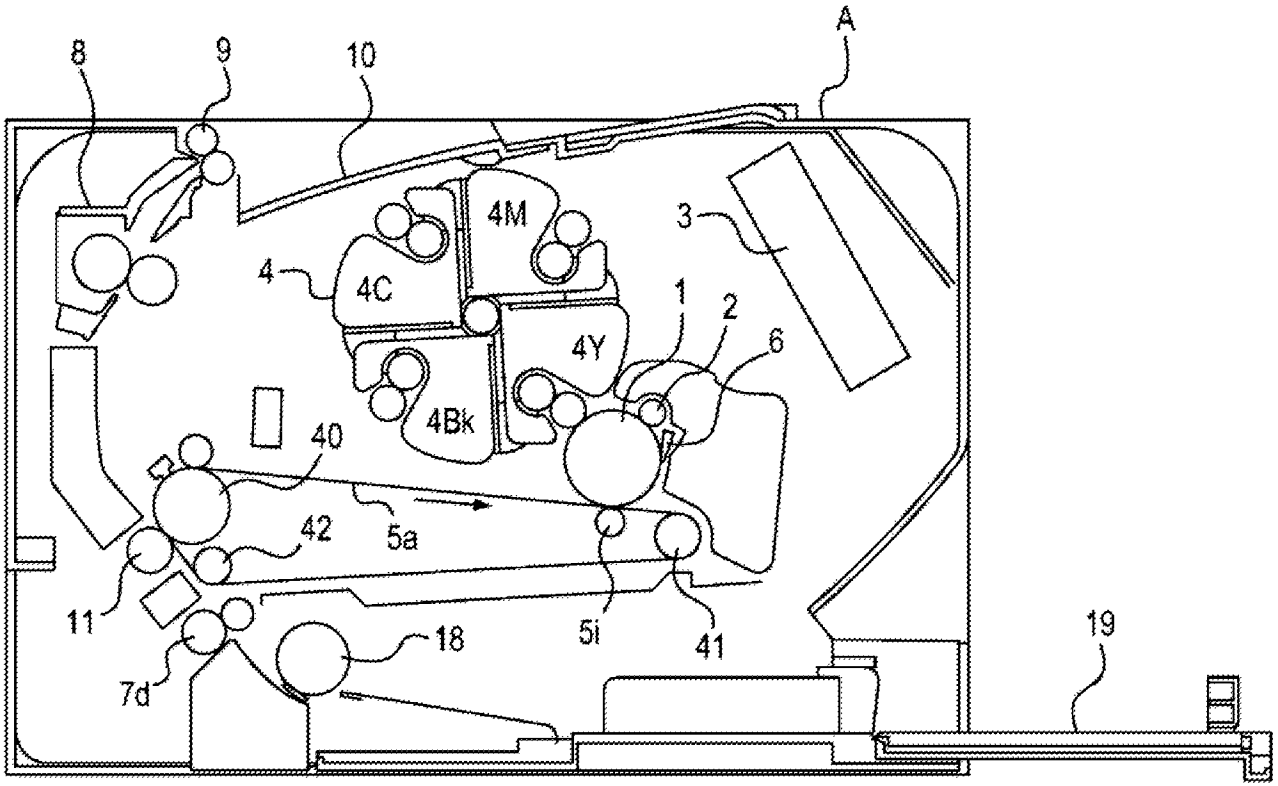
FIG. 1 is a configuration diagram of an image forming apparatus according to a present embodiment.

A schematic configuration of the image forming apparatus according to the present embodiment is illustrated in FIG. 1. According to the present embodiment, the image forming apparatus includes a drum-shaped electrophotographic photosensitive body, i.e. a photosensitive drum 1, acting as an image bearing member. The photosensitive drum 1 can be rotated by a drive unit.

A charge roller 2, an exposure unit 3, a rotary developing unit 4A and a cleaning blade 6 are placed around the photosensitive drum 1. A laser beam emitted from the exposure unit 3 is irradiated on the photosensitive drum 1.

The rotary developing unit 4A can rotate by supporting developing devices 4Y, 4M, 4C, and 4Bk containing yellow toner, magenta toner, cyan toner and black toner, respectively. The developing devices 4Y, 4M, 4C and 4Bk have the same internal configuration. Thus, names of the developing devices are not distinguished and will be referred to as the developing device(s) 4 when the tonners contained therein are not distinguished particularly.

All the developing devices 4 are configured to be mountable on the rotary developing unit 4A. The rotary developing unit 4A is rotatably supported with the developing devices 4 mounted and is able to move a desired developing device 4 to a position placed in face-to-face contact with the photosensitive drum 1.

An intermediate transfer belt 5*a* which is a transfer belt (hereinafter referred to simply as a "transfer belt") is placed below the photosensitive drum 1 by being stretched around multiple rollers 40, 42 and 41. A primary transfer roller 5*i* is placed across the transfer belt 5*a* from the photosensitive drum 1. A secondary transfer roller 11 is placed on the opposite side of the transfer belt 5*a* from the roller 40 which is one of the rollers over which the transfer belt 5*a* is stretched. The secondary transfer roller 11 is configured to be able to abut against and separate from the transfer belt 5*a*.

Image forming operation of the image forming apparatus will be described.

A sheet stacked on a stacking tray 19 is separated and fed by a pickup roller 18 and conveyed to a nip (secondary transfer portion) between the belt 5*a* and secondary transfer roller 11 by a conveyance roller pair 7*d*. The sheet conveyed to the secondary transfer portion is subjected to secondary transfer of toner images by the secondary transfer roller 11. Then, toner images of multiple colors are fixed on the sheet by a fixing device 8, and the sheet is ejected to a delivery tray 10 by a delivery roller 9.

A surface of the photosensitive drum 1 rotating at 100 mm/sec is charged to a predetermined potential by the charge roller 2. Electrostatic latent images are formed on the photosensitive drum 1 at an exposure position by a laser beam emitted according to image signals of different colors. The electrostatic latent images thus formed are developed at a developing position by the developing devices 4 to form toner images. The developing devices 4 developing at the developing position have been established according to the image signals of respective colors, and the developing device 4 of a desired color is placed at the developing position in advance by rotating the rotary developing unit 4A. The toner images are developed in a predetermined order of colors. According to the present embodiment, the toner images are formed in the order: yellow, magenta, cyan and black.

The toner images formed on the photosensitive drum 1 are transferred onto the intermediate transfer belt 5*a* at a primary transfer position. As the transferred toner images are superimposed one over another in order, a full-color toner image is formed on the intermediate transfer belt 5*a*. The secondary transfer roller 11 is located away from the transfer belt 5*a* until the full-color toner image is formed, and is abutted against the transfer belt 5*a* after the full-color toner image is formed. The sheet is conveyed, being timed with arrival of the formed full-color toner image at a secondary transfer position. The sheet stacked on the stacking tray 19 is separated and fed by the pickup roller 18 and conveyed to the nip (secondary transfer position) between the belt 5*a* and secondary transfer roller 11 by the conveyance roller pair 7*d*. The sheet conveyed to the secondary transfer position is subjected to secondary transfer of toner images by the secondary transfer roller 11. Then, toner image is fixed on the sheet by the fixing device 8, and the sheet is delivered to the delivery tray 10 by the delivery roller 9.

Figure 2:
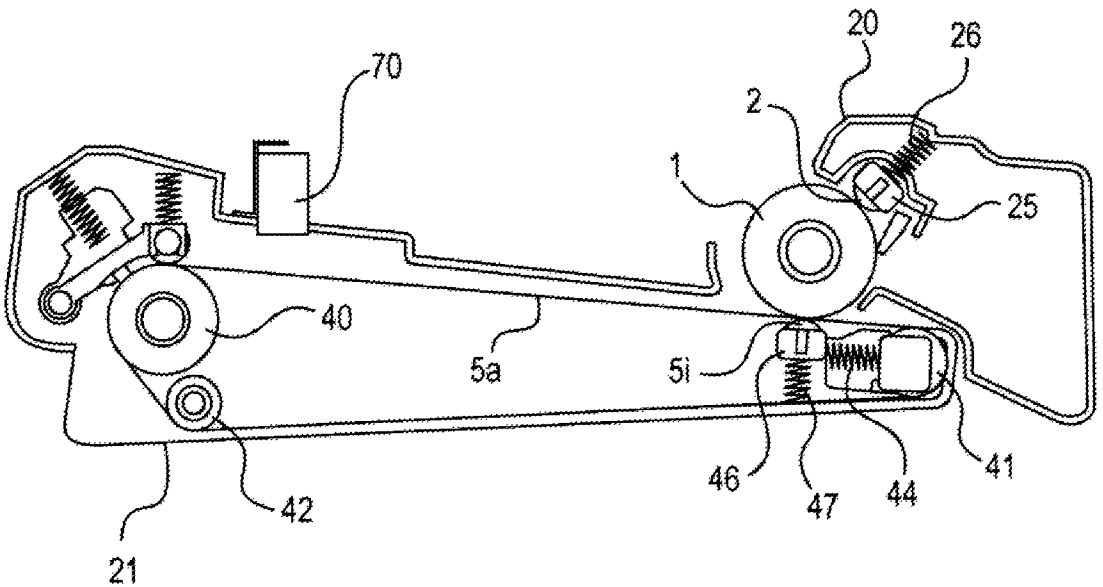
FIG. 2 is a sectional view of a belt unit and drum cartridge unit.
Figure 3:
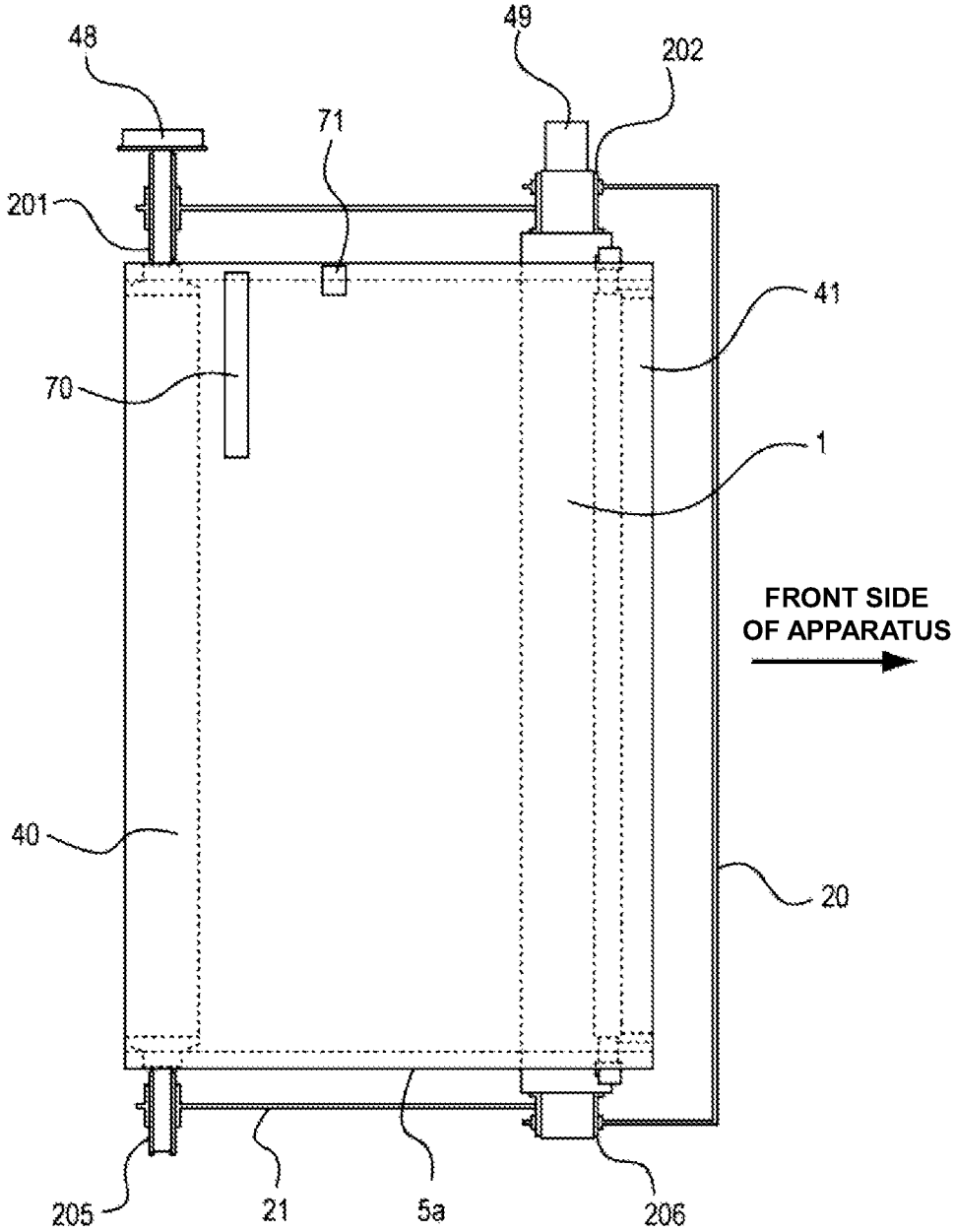
FIG. 3 is a top view of the belt unit and drum cartridge unit.

The transfer belt and multiple tension rollers are unitized into a transfer belt unit 21. FIG. 2 is a sectional view of the transfer belt unit 21 and a photosensitive drum unit 20. FIG. 3 is a top view of the intermediate transfer belt unit 21 and photosensitive drum unit 20.

As shown in FIG. 2, the transfer belt unit 21 includes the transfer belt 5*a*, the primary transfer roller 5*i*, a driving roller 40, a pressure roller (driven roller) and a support roller 42. The belt 5*a* is stretched around the rollers 40, 41 and 42 and rotated by the driving roller 40. The primary transfer roller 5*i* is placed across the belt 5*a* from the photosensitive drum 1, pressure contacted with the belt 5*a* by a compression spring 47 with a predetermined force via a bearing 46 and driven to rotate. A transfer member other than the primary transfer roller may be used alternatively. A transfer blade or transfer sheet may be used as the transfer member.

The pressure roller (tension roller) 41 applies a predetermined tension to the belt 5*a* by being urged outward from an inner surface of the belt by a compression spring 44. The pressure roller 41 follows rotation of the belt 5*a*. The driving roller 40 is rotatably held at opposite ends by a bearing 201 and bearing 205 as shown in FIG. 3, and a predetermined rotational driving force is transmitted from an apparatus body via the bearing 201 and a drive gear 48.

The belt 5*a* is made of a polyvinylidene fluoride (PVDF), polyimide (PI), or other resin film. The driving roller 40 is made of an aluminum pipe or the like whose surface is covered with a rubber layer (surface layer) having a high coefficient of friction μ to transmit a rotational force reliably to the belt 5*a*. The pressure roller 41 is made of metal (aluminum pipe or the like) and treated to give a smooth surface so as to keep down the coefficient of friction μ of the surface.

The photosensitive drum unit 20 includes the photosensitive drum 1 and charge roller 2. The charge roller 2 is pressure contacted with the photosensitive drum by a compression spring 26 via a bearing 25. The photosensitive drum 1 is rotatably held at opposite ends by a bearing 202 and bearing 206 as shown in FIG. 3, and a predetermined rotational driving force is transmitted from the apparatus body via a drive transmission device 49.

The transfer belt unit 21 is provided with an optical sensor 70 which is a position detection unit. A marker 71 which is a light reflector is pasted outside an image forming area at an end of the belt 5*a* in the belt width direction (in a direction orthogonal to a rotational direction of the belt 5*a*). The optical sensor 70 irradiates light on the marker 71 and detects reflected light and thereby detects a reference position for the image write position in a conveyance direction of the belt 5*a* (in a direction orthogonal to the belt width direction). Timing for the exposure unit 3 to write image data onto the photosensitive drum 1 is controlled in synchronization with a detection signal. Consequently, positions of toner images of different colors to be superimposed on the intermediate transfer belt are registered with each other.

The rotational speed of the belt 5*a* has to be stable in order to synchronize image write timing. If the rotational speed is unstable, the image write timing cannot be synchronized, resulting in a color misregistration of the image.

Figure 4:
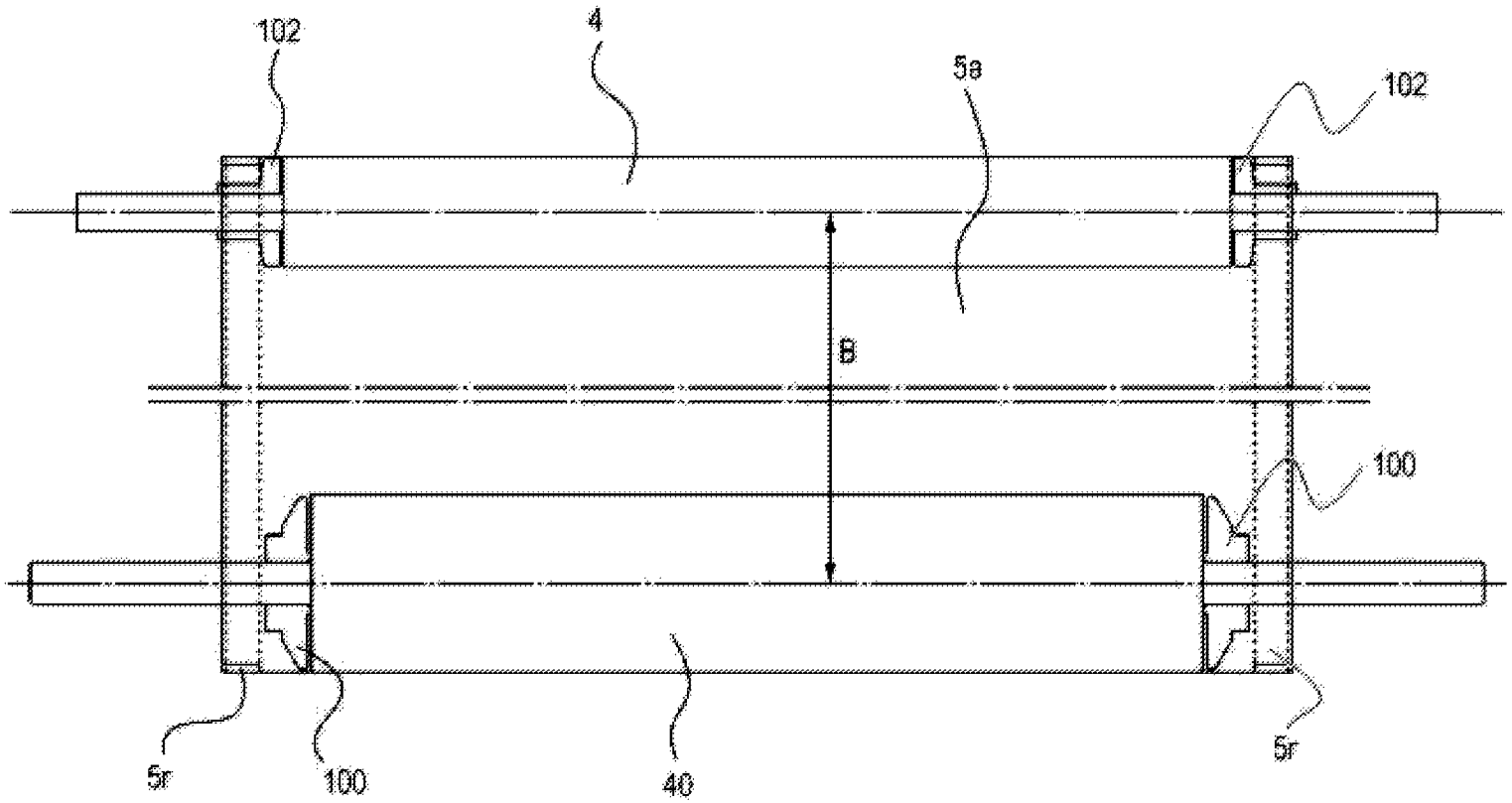
FIG. 4 is an explanatory diagram of a belt skew correction mechanism.
Figure 5:
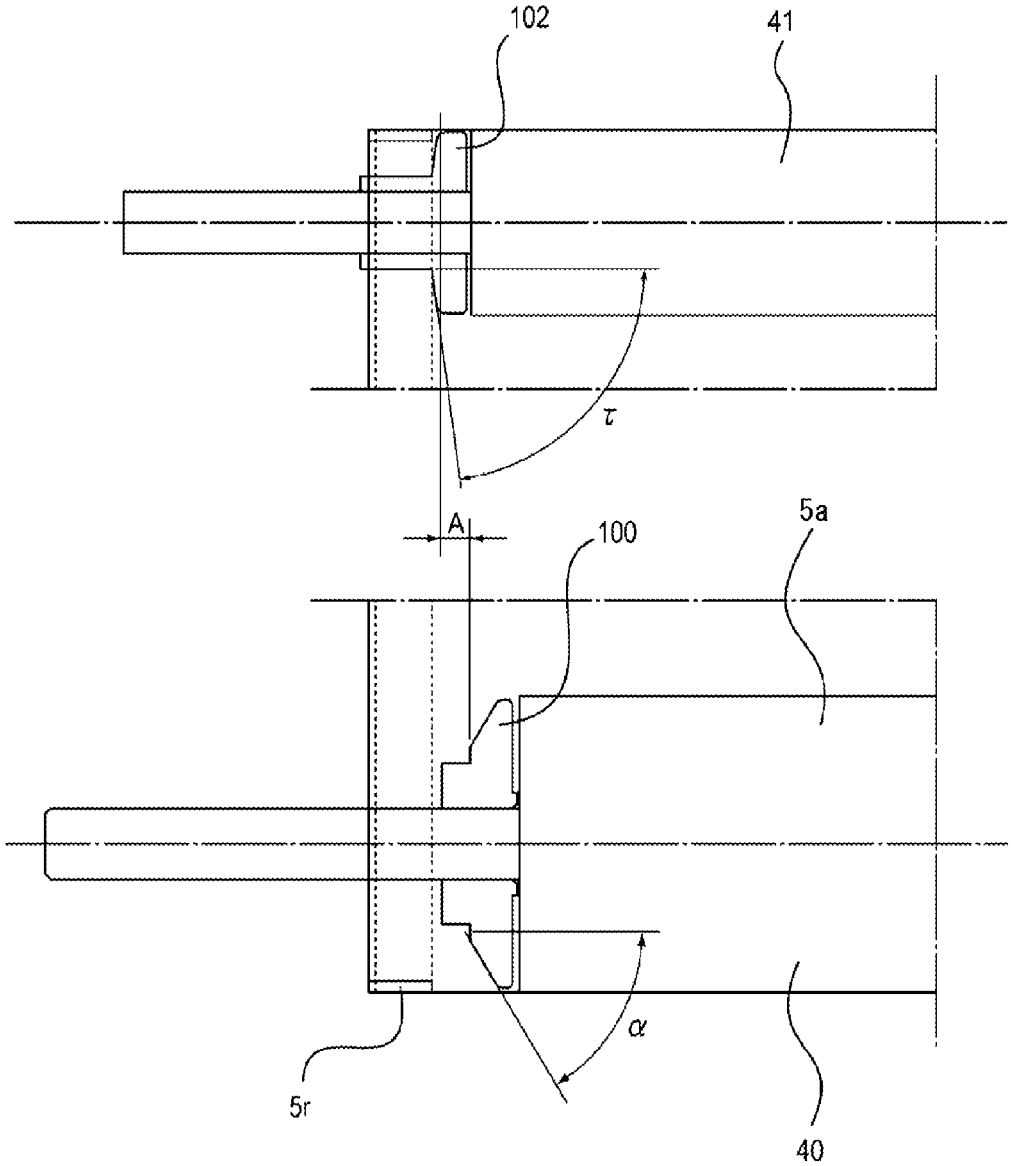
FIG. 5 is an explanatory diagram of the belt skew correction mechanism.

A correction mechanism of the intermediate transfer belt 5*a* will be described. FIGS. 4 and 5 are explanatory diagrams of the correction mechanism of the intermediate transfer belt 5*a*. As shown in FIGS. 4 and 5, the correction mechanism of the intermediate transfer belt 5*a* includes ribs 5*r* serving as guide portions, first restriction members 102 and second restriction members 100.

The ribs 5*r* which serve as guide portions are provided in strips along the rotational direction of the belt 5*a* on opposite ends of an inner circumferential surface of the belt 5*a*. The ribs 5*r* are made of an elastic material such as polyurethane foam or urethane rubber. The ribs 5*r* are pasted with an adhesive such as double-faced tape to maintain straightness. The restriction members 100 are provided on opposite ends of the driving roller 40 rotatably around a shaft of the driving roller 40.

Spacers (not shown) coated with fluorine or the like and made of a material with a low coefficient of friction μ are provided between inner surfaces of the restriction members 100 and the driving roller 40. The restriction members 100 have opposing surfaces which oppose the ribs, where the opposing surfaces are inclined surfaces which are inclined from the outer side to the inner side in the belt width direction as shown in FIGS. 4 and 5. The belt width direction is a direction orthogonal to the rotational direction of the belt. The restriction members 102 are provided on opposite ends of the pressure roller 41 rotatably with respect to the pressure roller 41. The restriction members 102 are approximately equal in diameter to the pressure roller 41, and have opposing surfaces which oppose the ribs, where the opposing surfaces are inclined surfaces which are inclined from the outer side to the inner side in the belt width direction as shown in FIGS. 4 and 5. Spacers (not shown) coated with fluorine or the like and made of a material with a low coefficient of friction μ are provided between inner surfaces of the restriction members 102 and the pressure roller 41.

As shown in FIG. 5, the restriction members 100 are placed nearer to the center of the belt 5*a* in the belt width direction by a distance A than the restriction members 102. When a skewing force along the belt width direction acts on the belt 5*a*, the ribs 5*r* first abut the inclined surfaces of the restriction members 102. As the ribs 5*r* abut the inclined surfaces of the restriction members 102, a force returning the belt 5*a* outward along the belt width direction is applied to the belt 5*a* which tends to move inward along the belt width direction. Consequently, the skewing of the belt 5*a* is restricted.

The skewing forces acting on the belt 5*a* are generated on shafts with a high coefficient of friction. Thus, the largest skewing force is applied to the belt 5*a* on the driving roller 40 having a rubber layer with a high coefficient of friction μ. Therefore, even if the skewing of the belt 5*a* is restricted by the restriction members 102 on the shaft of the pressure roller 41, the belt 5*a* may tend to skew outward along the belt width direction on the shaft of the driving roller 40. In that case, although the skewing of the belt 5*a* on the shaft of the pressure roller 41 is restricted, the skewing of the belt 5*a* on the shaft of the driving roller 40 cannot be avoided.

The skew generated on the shaft of the driving roller 40 is restricted as the belt 5*a* abuts the restriction members 100 by further moving the distance A in the belt width direction from the position where the belt 5*a* bumps against the restriction members 102. Specifically, the belt skew is restricted as the restriction members 100 apply an outward return force along the belt width direction to the belt 5*a* abutting the restriction members 100.

According to the present embodiment, as shown in FIG. 5, the inclined surfaces of the restriction members 102 and restriction members 100 have different angles. A large inclination angle causes the skewing force to act almost as normal drag on the inclined surfaces of the restriction members, ensuring a large restriction force. However, a large inclination angle increases an amount of run-on of the ribs 5*r* in a radial direction of the restriction members. On the other hand, a small inclination angle provides a small restriction force, but causes a small amount of run-on.

In terms of the run-on part, when the ribs 5*r* run on the restriction members, the circumferential length of the belt 5*a* becomes longer. An increase in the circumferential length in even a part of the belt 5*a* causes speed fluctuations. In particular, the rotational speed of the belt 5*a* is determined on the shaft of the driving roller 40, and thus the smaller the amount by which the ribs 5*r* run on the driving roller 40, the better. Thus, according to the present embodiment, an inclination angle α of the restriction member 100 on the shaft of the driving roller is smaller than an inclination angle τ of the restriction member 102 on the shaft of the pressure roller. According to the present embodiment, a situation in which the ribs 5*r* contacts with the restriction members 100 is a situation in which the restriction members 102 with large restriction forces impart forces to cancel out the skew. Thus, even a small inclination angle brings about sufficient effects.

Since the surface of the pressure roller 41 is made of a smooth aluminum pipe or the like which has a low coefficient of friction μ, the restriction members 102 can restrict skew with a small force. On the other hand, since the surface of the driving roller 40 is covered with a rubber layer having a high coefficient of friction μ, a large force is required to restrict skew. Since the skew is restricted first with a small force by the restriction members 102 provided on the pressure roller 41, the restriction of the skew by the restriction members 100 provided on the driving roller 40 becomes small. Thus, loads on the belt 5*a* and ribs 5*r* are reduced and resulting in extended service life. This stabilizes conveyance speed of the belt 5*a*, prevents unsynchronized image write timing, prevents color misregistration, and thereby executes high-quality image forming.

When the distance between the inclined surface of the restriction member 100 and inclined surface of the restriction member 102 is A and the center distance between the driving roller 40 and pressure roller 41 is B, the components are placed so as to satisfy $0.0052 \leqq A/B \leqq 0.0116$. If A/B is less than 0.0052, the restriction members 100 start to restrict the skew of the belt before the restriction members 102 can restrict the skew sufficiently. This increases the force with which the ribs 5*r* are restricted on the driving roller 40 by the restriction members 100, increasing in turn the loads on the belt and ribs 5*r* and resulting in reduced resistance to damage and the like. On the other hand, if A/B is larger than 0.0116, an amount of diagonal deformation of the belt itself increases, causing the belt to undulate and thereby resulting in wavy images.

Figure 6:
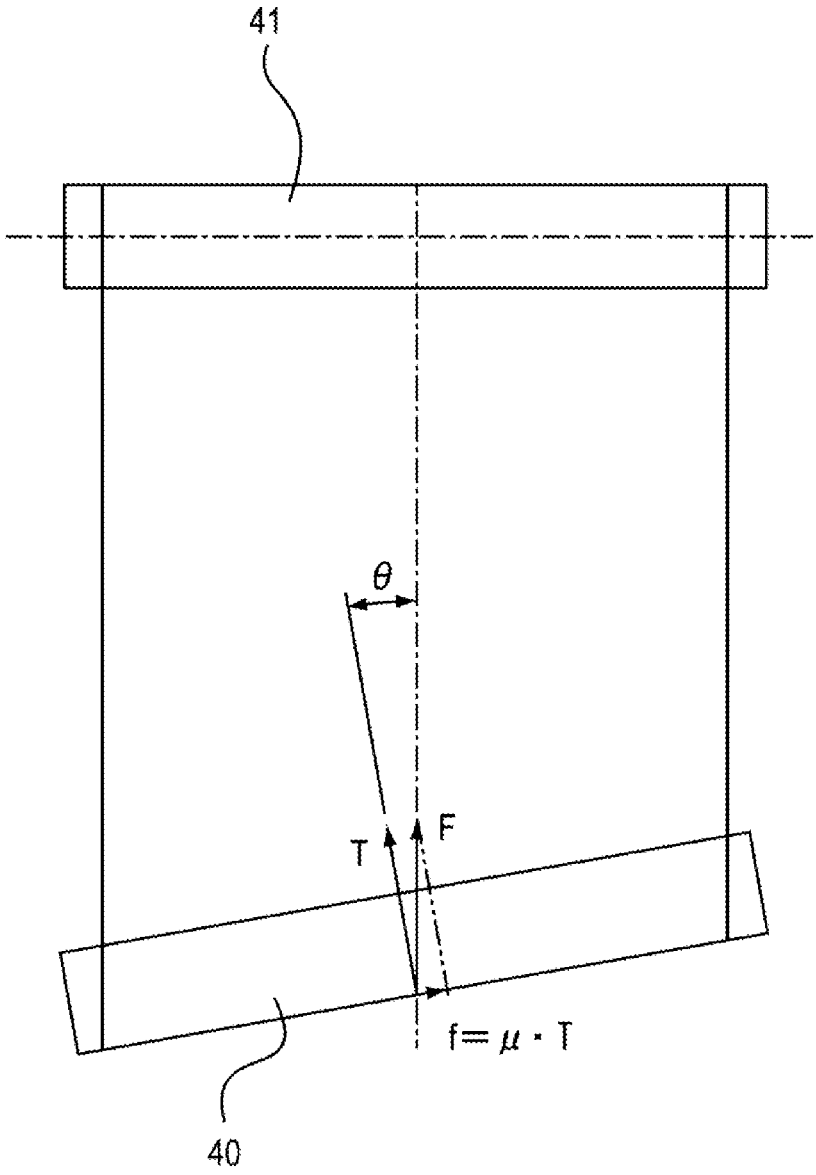
FIG. 6 is a conceptual diagram of a belt skewing force.

FIG. 6 is a conceptual diagram of a skewing force of the intermediate transfer belt. A belt driving force F (belt tension) transmitted from the driving roller 40 to the belt 5*a*, the coefficient of friction μ between the driving roller 40 and belt 5*a*, and drag T generated by the belt tension F and perpendicular to the driving roller 40 are shown in FIG. 6. The skewing force f of the belt 5*a* is given by $f=\mu \cdot T$. Thus, the skewing force f increases with increases in an inclination of the roller, the coefficient of friction μ between the belt and roller, and the belt driving force F.

Figure 7:
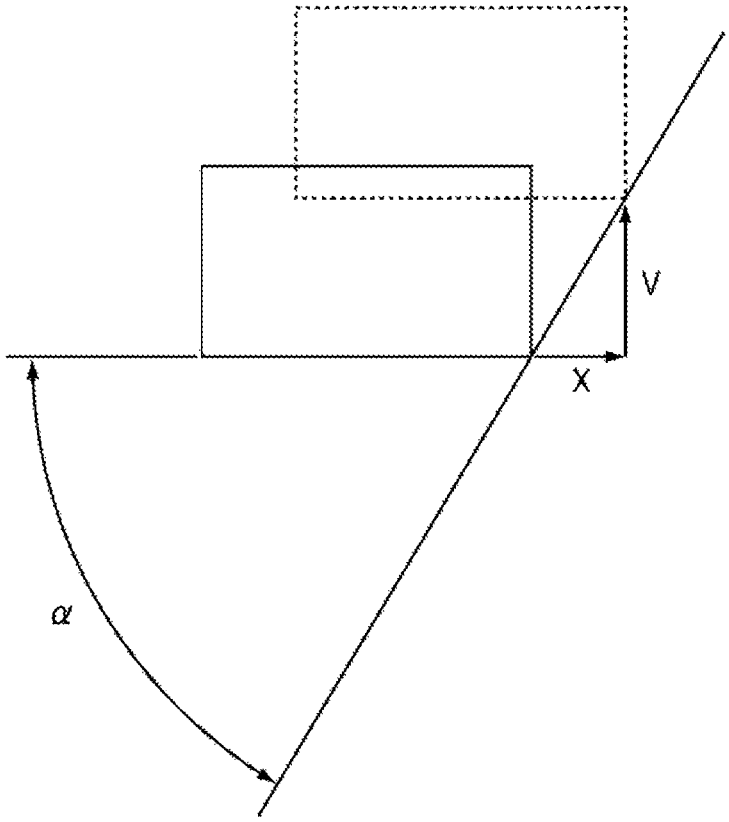

FIG. 7 is a conceptual diagram showing an amount of belt run-on which occurs when the ribs 5*r* of the belt 5*a* bump against the restriction members 100 provided on the opposite ends of the driving roller 40. In FIG. 7, x is the distance by which the rib 5*r* moves in the skew direction when the skew is restricted by the restriction member 100, α is the restriction angle of the restriction member 100, and v is the amount of run-on of the rib 5*r*. Then, the relationship $v=x \cdot \tan(\alpha)$ holds. Thus, the smaller the restriction angle α, the smaller the amount v of run-on.

A support roller 42 is placed sufficiently away from the ribs 5*r* to prevent opposite ends of the support roller 42 from restricting the ribs 5*r*. The center distance B between the pressure roller 41, on which restriction members restricting the skew of the belt are provided, and driving roller 40 is larger than the center distance between the support roller 42, on which restricting of the skew of the belt is not executed, and driving roller 40. The increase in the distance B reduces A/B, and thereby decreases the amount of diagonal deformation of the belt itself. This prevents the belt from undulating and thereby prevents wavy images.

Figure 8:
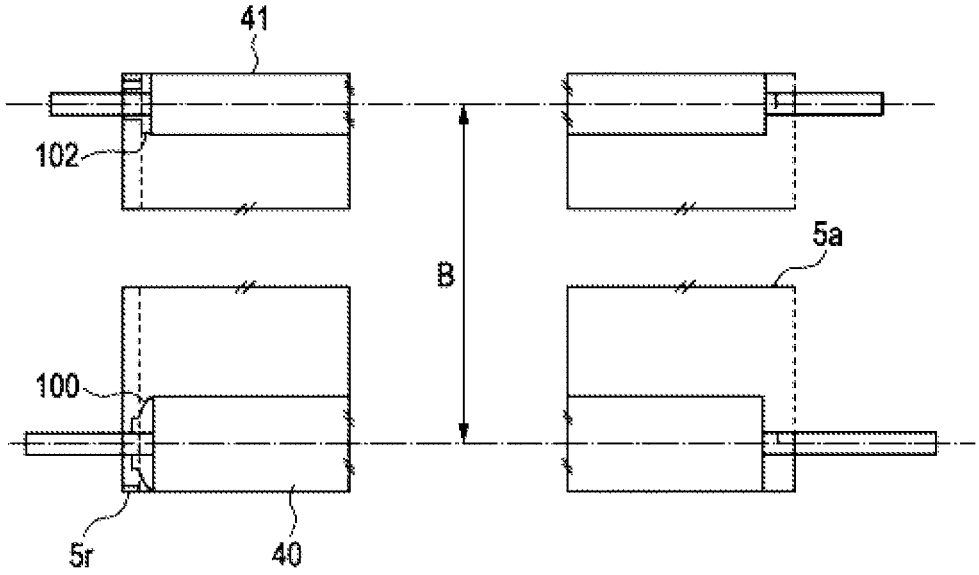
FIG. 8 is another explanatory diagram of the belt skew correction mechanism.

Also, as shown in FIG. 8, the present invention is also applicable when a rib is provided only at one end of the belt 5*a* and one restriction member each is provided only at one end of the driving roller 40 and pressure roller 41. Even if the rib and restriction member are provided only at one end, the skew of the belt can be avoided by restricting the skew direction of the belt 5*a* in one direction.

In the present embodiment, a rotary type color image forming apparatus having a single photosensitive drum has been described. However, the present invention is not limited to this, and is applicable to a tandem type color image forming apparatus having multiple photosensitive drums. Also, the present invention is not limited to intermediate-transfer type image forming apparatus, and is applicable to transfer/conveying belts of direct-transfer type image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-108626, filed May 10, 2010, which is hereby incorporated by reference herein in its entirety.

What is claimed is:

1. An image forming apparatus which transfers a toner image to a rotatable endless belt or transfers a toner image to a transfer material carried by a rotatable endless belt, comprising:

the rotatable endless belt;

guide portions each provided in strips on opposite ends of an inner circumferential surface of the endless belt;

a driving roller supporting and rotating the endless belt;

a driven roller supporting the endless belt and driven by the rotation of the endless belt;

first restriction members each provided on opposite ends of the driven roller in an axial direction of the driven roller, the first restriction members having first contact surfaces which come into contact with the guide portions when the endless belt moves in a belt width direction crossing a rotational direction of the endless belt; and second restriction members each provided on opposite ends of the driving roller in an axial direction of the driving roller, the second restriction members having second contact surfaces which come into contact with the guide portions when the endless belt moves in the belt width direction crossing the rotational direction of the endless belt, wherein the second contact surfaces of the second restriction members are placed nearer to a center in the belt width direction than the first contact surfaces of the first restriction members, and an angle between the first contact surfaces of the first restriction members and the inner circumferential surface in the belt width direction is larger than an angle between the second contact surfaces of the second restriction members and the inner circumferential surface in the belt width direction.

2. An image forming apparatus according to claim 1, wherein a coefficient of friction of a surface of the driving roller is higher than a coefficient of friction of a surface of the driven roller.

3. An image forming apparatus according to claim 1, wherein the following requirements are satisfied, $$0.0052 \leqq A/B \leqq 0.0116$$

when a distance in the belt width direction between the first restriction members and the second restriction members is A, and when a center distance between the driving roller and the driven roller is B.

4. An image forming apparatus according to claim 1, further comprising a support roller supporting the endless belt, in addition to the driving roller and the driven roller, wherein the center distance between the driving roller and the driven roller is larger than a center distance between the support roller and the driving roller.

5. An image forming apparatus according to claim 1, further comprising a support roller supporting the endless belt, the support roller supporting the endless belt so as to prevent from contacting with the guide portions when the endless belt moves in the belt width direction.

6. An image forming apparatus according to claim 1, wherein each of the first restriction members is rotatable relative to the driven roller.

7. An image forming apparatus according to claim 1, wherein each of the second restriction members is rotatable relative to the driving roller.

8. An image forming apparatus which transfers a toner image to a rotatable endless belt or transfers a toner image to a transfer material carried by a rotatable endless belt, comprising:

the rotatable endless belt;

a guide portion provided in a strip at one end of an inner circumferential surface of the endless belt;

a driving roller supporting and rotating the endless belt;

a driven roller supporting the endless belt and driven by the rotation of the endless belt;

a first restriction member provided on the driven roller on the side of the one end in an axial direction of the driven roller, the first restriction member having a first contact surface which comes into contact with the guide portion when the endless belt moves in a belt width direction crossing a rotational direction of the endless belt; and a second restriction member provided on the driving roller on the side of the one end in an axial direction of the driving roller, the second restriction member having a second contact surface which comes into contact with the guide portion when the endless belt moves in the belt width direction crossing the rotational direction of the endless belt, wherein the second contact surface of the second restriction member is placed nearer to a center in the belt width direction than the first contact surface of the first restriction member, and an angle between the first contact surface of the first restriction member and the inner circumferential surface in the belt width direction is larger than an angle between the second contact surface of the second restriction member and the inner circumferential surface in the belt width direction.

* * * * *